United States Patent [19]

Merkh

[11] Patent Number: 4,646,544

[45] Date of Patent: Mar. 3, 1987

[54] KNITTING EXPANDER DEVICE FOR FLAT BED KNITTING MACHINES

[75] Inventor: Ernst Merkh, Pfulligen, Fed. Rep. of Germany

[73] Assignee: H. Stoll GmbH & Co., Fed. Rep. of Germany

[21] Appl. No.: 864,408

[22] Filed: May 19, 1986

[30] Foreign Application Priority Data

May 24, 1985 [DE] Fed. Rep. of Germany ..... 3518778

[51] Int. Cl.[4] ..... D04B 15/88

[52] U.S. Cl. ..... 66/149 R

[58] Field of Search ..... 66/149, 147, 152

[56] References Cited

U.S. PATENT DOCUMENTS

| | | | |
|---|---|---|---|
| 3,633,387 | 1/1972 | Worner | 66/149 R |
| 4,488,416 | 12/1984 | Shima et al. | 66/149 R |
| 4,503,690 | 3/1985 | Goller et al. | 66/149 R |

*Primary Examiner*—Ronald Feldbaum

*Attorney, Agent, or Firm*—Larson and Taylor

[57] ABSTRACT

For a knitted fabric expander device on flat bed knitting machines, the guide bars positioned at the edge of the knitted fabric with their end projecting over the comb gap (13) are coupled in a detachable manner via a switch body (31) with a holder/expander (18) arranged beneath the needle beds (11, 12). The guide bars can be drawn upwards through the comb gap (13) together with the switch body (31) and reinserted from above into their adjustable or movable holder/expander (18).

8 Claims, 4 Drawing Figures

KNITTING EXPANDER DEVICE FOR FLAT BED KNITTING MACHINES

FIELD OF THE INVENTION

The invention relates to a knitted fabric expander device for flat bed knitting machines. The machine has at least two expanders/holders arranged slidably and lockably in the longitudinal direction at both sides of a knitting zone beneath the needle beds. A guide bar, projecting up, in each case, just above the comb gap and, projecting down to the region of a draw-down roller and running between guide rollers is positioned by the device.

BACKGROUND OF THE INVENTION

Knitted fabric expanders of the aforementioned type are already known through DE-PS No. 24 56 466 and DD-PS No. 204 114. Holders/expanders positioned beneath the needle beds for expander guide bars have the advantage that no carriers or adjusting rails for the guide bars are necessary above the needle beds, which would form an additional hinderance for the yarn guide. Hitherto proposed or known designs however, have the disadvantage that the guide bars can only be removed from the holders with difficulty, and adjustment of the holders is, in reality, only possible if a piece of knitting, the borders/edges of which are knitted around the guide bars, has left the guide bars again at the lower end. A further disadvantage exists in the fact that it is necessary to provide a good means of support for the guide bars in their region beneath the comb gap, due to the free exposed end of the guide bars projecting through the comb gap, which is only possible by a greater number of guide rollers or pairs of rollers, making the device expensive in terms of construction.

SUMMARY OF THE INVENTION

It is an object of the invention to design a knitted fabric expander device of the type mentioned above, such that a good securement of the bar is achieved with limited constructional expense and effort and that the guide bar holders can be adjusted at any time for any change occurring in the width of the knitting on the machine.

The stated task is resolved in accordance with the invention by the fact that the guide bar terminates at the top in a switch blade body for the yarn guides, which is also coupled to the respective holder of the knitted fabric expander device by means of a carrier bar also passing through the comb gap and which is detachable from this holder. In contrast to known devices, the fabric expander device features an attachment on the upper point of the guide bar, which has to be circumnavigated by the yarn guides when producing the knitting around the guide bar. This switch blade body is also coupled to the holder arranged beneath the needle beds via the carrier bar, dispensing with the need for an isolated/separated carrier lying above the needle beds. Furthermore, the top end of the guide bar is well supported by the switch blade body, so that in the region lying beneath the comb gap the guide bar only requires a simple and inexpensive support. The switch blade body can be pulled upwards at any time and detached from the holder arranged beneath the needle beds and the guide bar reinserted from above into the comb gap after adjustment of the holder and the carrier bar of the switch blade body located in the holder. A simple insertion contact is all that is required, whereby the carrier bar is inserted in an upper opening of the holder which can be designed as a height adjustable section of the holder. Securement of the carrier bar can be effected in the opening of the holder by means of an indexing-/ratchet-like device.

The operational reliability of the fabric expander device is considerably improved by the stabilization of the end of the guide bar to be circumknitted, and this is achieved by means of the switch blade body. Further improvement to the operational reliability can be achieved as a result of the guide bar featuring a single sharp, or several less pronounced, angular offsets, by which a knitting retaining edge is formed. This edge prevents an undesired pulling up of the loops/stitches along the guide bar during the lifting of the needle or needles forming the border/edging loop or loops. In addition, this can also be achieved if the guide bar beneath the comb gap is provided on the side facing away from the knitting with tooth-like retaining knops which also prevent an undesired drawing up of the knitting.

The switch blade body can be designed such that it causes no hinderance to the yarn guides. For this, the switch blade body can be provided with a bottom edge cutout between the guide bar and the carrier bar running basically parallel to it at the distance corresponding to a multiple of the needle division/gauge transforming into a throat/scallopped area on both sides at the top. This permits the plunging of the yarn guides into the interspace between the guidebar and the carrier bar from the front or the rear. With this, the plate-shaped switch blade body can operate as a true switching blade/deflector on which a yarn guide part can be supported.

An oscillatory motion can be imported to the guide bar from the carriage via an expander/holder guided on all sides, or via a separate drive, aiding the sliding down/off of the knitted fabric along the guide bars.

An embodiment of a knitted fabric expander device formed in accordance with the invention is explained in more detail in the following with the aid of the enclosed drawings.

DETAILED DESCRIPTION OF THE PREFERRED EMBODIMENT

Figure 1:
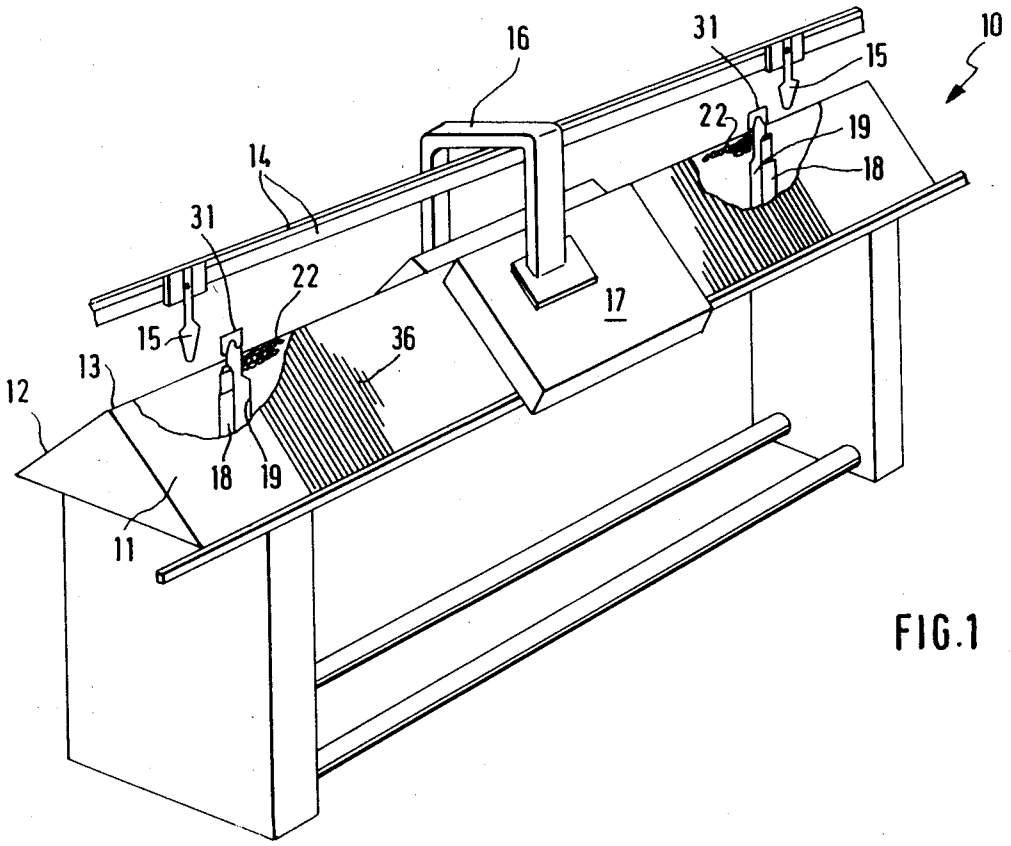
FIG. 1 is a diagrammatic perspective view of a twin flat-bed knitting machine having a knitted fabric expander device.

FIG. 1 diagrammatically shows a flat bed knitting machine 10 of V-shaped profile having a front needle bed 11 and a rear needle bed 12 which together form the comb gap 13 of the machine. Above the two needle beds 11 and 12 are adjustable or movable rails 14 for the yarn guides 15. A bracket 16 of the machine carriage 17 extends over these yarn guide rails 14.

At both end regions of the needle beds 11 and 12 and fitted beneath these is a holder/expander 18 of the knitted fabric expander device in each case. Each holder-/expander 18 carries a guide bar 19. Guide bar 19 projects upwards through the comb gap 13 and extends downwards to the zone of the fabric draw-down rollers 20 and 21 indicated in FIG. 2. Guide bar 19 is also circumknitted by edging/border stitches of the formed knitting 22. The knitting fabric slides downwards on the guide bars 19 to the zone of the draw-down rollers 20, 21, and is held taut by the guide bar 19. In order to circumknit the guide bars 19, the yarn guides 15 partly pass by in front of the end of the guide bar 19 projecting upwards through the comb gap 13 and partly pass by at the back of guide bar 19.

Figure 2:
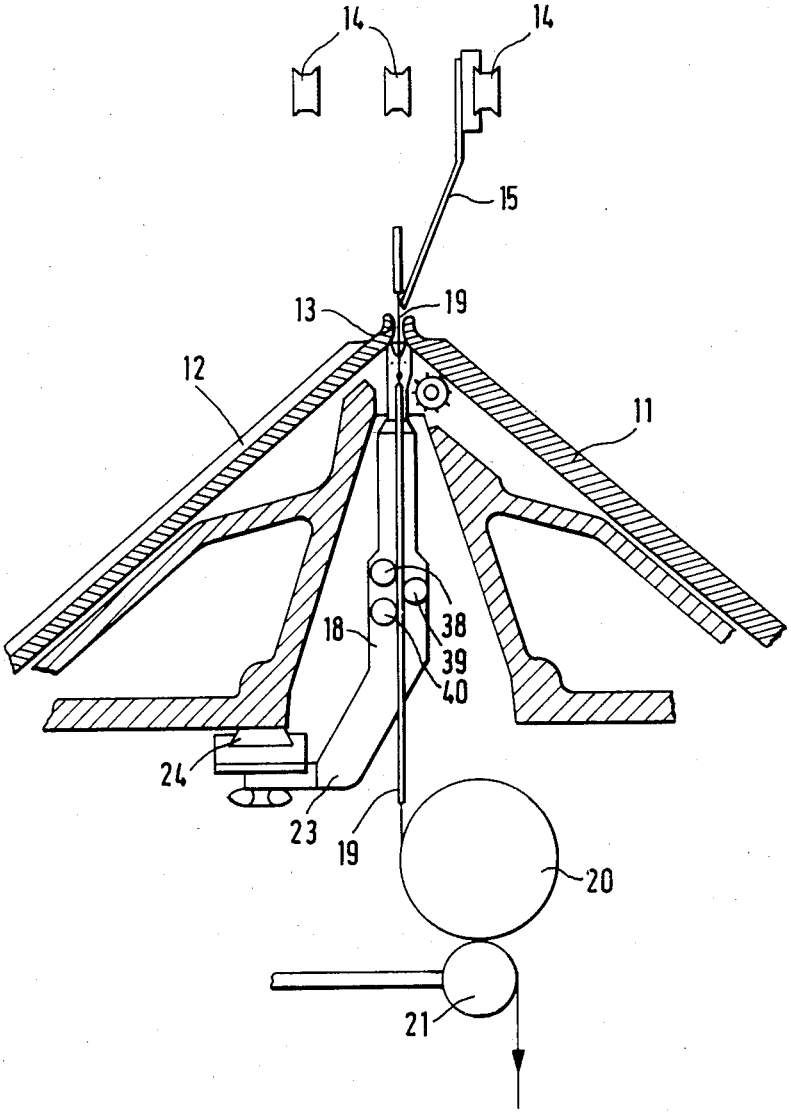
FIG. 2 is a diagrammatic cross-section through the two needle beds having an expander/holder of the knitted fabric expander device.
Figures 3, 4:
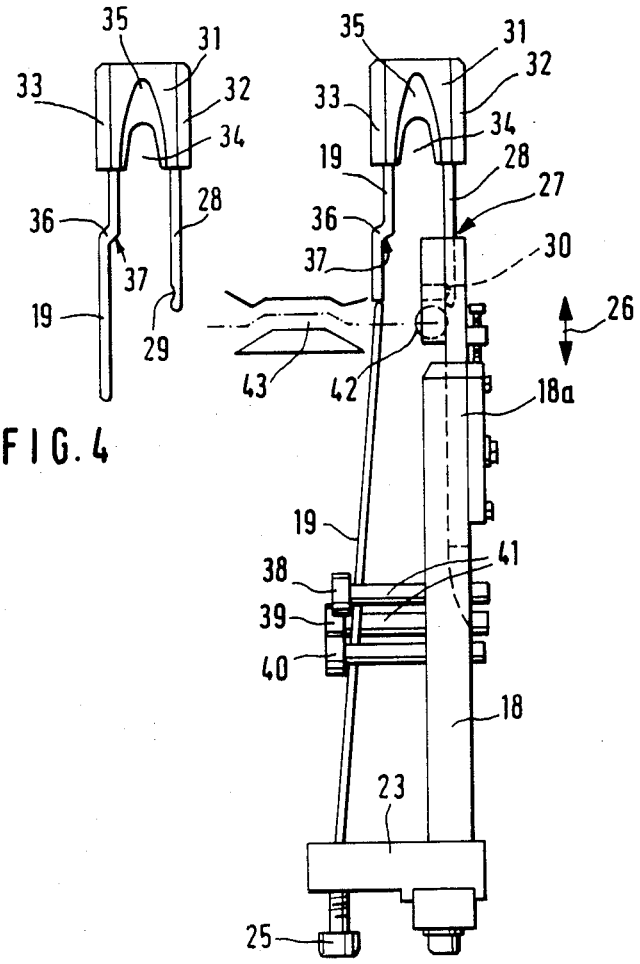
FIG. 3 is an individual presentation of an expander/-holder of the knitted fabric expander device at a larger scale to that of FIGS. 1 and 2.
FIG. 4 is an individual presentation of the guide bars and its support.

As FIG. 2 shows, the holders/expanders 18 having a laterally projecting foot section 23 on a guide rail 24 are arranged off-center beneath the needle bed 12 extending over the entire length of the machine and are located so as to be capable of adjustment or movement. The design of the holder/expander 18 and the support of the guide bar 19 can be seen in detail in FIG. 3. The laterally projecting foot section 23 of the holder/expander 18 can be locked with the aid of a clamping screw 25 to the guide rail 24. The holder/expander 18 features an upper part 18*a* adjustable on all sides. Upper part 18*a* is designed to be adjustable or movable in height and, if need be, in oscillation in the direction of the double arrow 26 marked in FIG. 3. An opening 27 is formed in upper part 18*a* which is accessible from above for a carrier bar 28. As FIG. 4 shows, the carrier bar 28 has a notch 29 on its bottom end in which a spring-loaded indexing ball 30, fitted in the top section 18*a* of the holder/expander 18, can engage for locking the carrier bar 28 in its expanded position.

The top end of the carrier bar 28 fixes into a narrow plate-shaped switch body 31, which runs out at both ends into wedge surfaces (blades) 32 and 33. The top end of the guide bar 19 fits into switch body 31. The distance between the carrier bar 28 and the top end of the guide bar 19 corresponds to a multiple needle pitch in the needle beds 11, 12 of the flat bed knitting machine 10. The switch blade body 31 features, between its respective openings for the carrier bar 28 and the guide bar 19, a deep bottom edge cutout 34. Cutout 34 transforms upwards into a tapering throat or scallop 35 on the front side as seen in FIG. 3 and also on the backside of the switch blade body 31. On each side, the scallop extends almost to the edge of the switch blade body 31. The edge cutout 34 and the scallop 35 enable the yarn guides 15 to feed the needles of the needle beds 11, 12 lying between the carrier bar 28 and the guide bar 19 to circumknit the guide bar 19.

The guide bar 19 is provided with an angular offset 36 at a position lying beneath the comb gap 13 by which a knitted fabric retaining edge 37 is formed. This prevents the circumknitted loops from riding or pulling up on the guide bar 19 during the lifting of the needles.

At its bottom part, the guide bar 19 is guided between three rollers 38, 39 and 40 which are adjustably located on elements 41 secured in the holder/expander 18.

The switch blade body 31 and the top sections of the guide bar 19 and the carrier bar 28 project upwards from the comb gap 13 of the flat bed knitting machine 10. The yarn guides 15 can pass by on the switch blade body 31 at the front and rear. The yarn guides 15 can even be supported on the switch body depending upon the design of the yarn guide. The switch blade body 31 with the guide bar 19 and carrier bar 28 can be detached at any time from the holder/expander 18 and be drawn out upwards from the comb gap 13 of the machine before adjusting the holder/expander 18 for differing fabric widths; and can easily be reinserted from above through the comb gap 13 into the holder/expander 18.

Although the present invention has been described with respect to an exemplary embodiment thereof, it will be understood by those of ordinary skill in the art that variations and modifications can be affected within the scope and spirit of the invention.

I claim:

1. A knitted fabric expander device for a longitudinal flat bed knitting machine having (a) a region of knitted fabric, (b) needle beds and, (c) yarn guide, said expander device comprising:

at least two holders/expanders arranged on respective sides of the region of knitted fabric and beneath the needle beds so as to be longitudinally slidable and lockable, respective guide rollers and a draw-down roller located therebetween, which said rollers are mounted at a lower part of respective said holders-/expanders, a respective guide bar, mounted by a respective said holder/expander, which projects upwards to just above the comb gap and downwards to the region of a respective draw-down roller, and a means for mounting a respective said guide bar to a respective said holder/expander including (a) a carrier bar which projects through the comb gap and which is connected at one side to said holder-/expander, and (b) a switch body which is detachably connected to said holder/expander by said carrier bar and which acts as a deflecting body for the yarn guides, said guide bar being attached to said switch body whereby said guide bar is detachably connected to said holder/expander.

2. A knitted fabric expander device in accordance with claim 1, characterized in that the guide bar (19) has at least one projection beneath the comb gap (13) which forms a knitted fabric retaining edge (37).

3. A knitted fabric expander device in accordance with claim 2, characterized in that the carrier bar (28) is mounted in an opening (27) in the upper part of said holder/expander bar (18).

4. A knitted fabric expander device in accordance with claim 3, characterized in that the carrier bar (28) is secured in the opening (27) of the holder/expander (18) by an indexing/ratchet locking means.

5. A knitted fabric expander device in accordance with claim 1, characterized in that: an upper end section of the guide bar (19) and the carrier bar (28) are substantially parallel and are separated by a distance which corresponds to a multiple divisional pitch/guage; that the switch body (31) is plate shaped and aligned in the direction of the comb gap (13) between the fixing points for the guide bar (19); and that the carrier bar (28) features a bottom edge cutout (34), which extends upwards on both sides transforming into a scallop (35).

6. A knitted fabric expander device in accordance with claim 1, characterized in that the holders/expanders (18) include a guide rail (24) running parallel over the entire length of the machine outside of the vertical plane running through the comb gap and (13) beneath a rear needle bed (12), and a laterally projecting foot part (23) which is located on said guide rail.

7. A knitted fabric expander device in accordance with claim 3, characterized in that the opening (27) for the carrier bar (28) is formed into a height adjustable part (18*a*) of the holder/expander (18).

8. A knitted fabric expander device in accordance with claim 7, characterized in that the part (18*a*) of the holder/expander (18) accepting the carrier bar (28) of the switch body (31) is provided with a guide foot (42) which operates in conjunction with a guide track (43) in the machine carriage for the purpose of achieving an oscillatory motion of the guide bar (19).

* * * * *